US005659280A

United States Patent [19]

Lee et al.

[11] Patent Number: 5,659,280

[45] Date of Patent: Aug. 19, 1997

[54] APPARATUS AND SYSTEM FOR MAGNETIZATION OF PERMANENT MAGNET CYLINDER ELEMENTS

[75] Inventors: J. Kelly Lee; Svetlana Reznik, both of Rochester; Edward P. Furlani, Lancaster, all of N.Y.

[73] Assignee: Eastman Kodak Company, Rochester, N.Y.

[21] Appl. No.: 658,331

[22] Filed: Jun. 5, 1996

[51] Int. Cl.[6] ..... H01F 7/20; H01F 13/00

[52] U.S. Cl. ..... 335/284; 399/277

[58] Field of Search ..... 399/277; 335/284, 335/289; 361/143, 147; 355/251

[56] References Cited

U.S. PATENT DOCUMENTS

| | | | |
|---|---|---|---|
| 4,166,263 | 8/1979 | Harada et al. | 335/284 |
| 4,167,718 | 9/1979 | Harada et al. | 335/284 |
| 4,168,481 | 9/1979 | Harada et al. | 335/284 |
| 4,169,998 | 10/1979 | Harada et al. | 335/284 |
| 4,354,218 | 10/1982 | Steingroever et al. | 361/147 |
| 5,200,729 | 4/1993 | Soeda et al. | 335/284 |
| 5,319,335 | 6/1994 | Huang et al. | 335/284 |

FOREIGN PATENT DOCUMENTS

| | | | |
|---|---|---|---|
| 5-243047 | 9/1993 | Japan | 335/284 |
| 0819828 | 4/1981 | U.S.S.R. | 335/284 |

*Primary Examiner*—Matthew S. Smith
*Attorney, Agent, or Firm*—Lawrence P. Kessler

[57] ABSTRACT

A system for forming desired magnetization patterns in permanent magnet structures such as magnetic brush cylinders cores, utilizes a fixture having a plurality of magnetizing members selectively orientable to the permanent magnet structures and couplable to a capacitor discharge magnetization apparatus. Magnetic tip members can have different flux focusing end configurations to form corresponding polarization patterns in the permanent magnet cylinder structures.

11 Claims, 5 Drawing Sheets

APPARATUS AND SYSTEM FOR MAGNETIZATION OF PERMANENT MAGNET CYLINDER ELEMENTS

FIELD OF THE INVENTION

The present invention relates to apparatus and systems for magnetizing patterns of polarization upon permanent magnet cylinder elements, used for example in electrographic magnetic brushes, and more particularly to improvements in such apparatus and systems that enable more versatile and effective magnetization.

BACKGROUND OF INVENTION

Permanent magnet cylinder elements (e.g. cylinders and sections of cylinders) having radial polarization patterns, are used extensively in electrostatographic imaging apparatus. In one use, such cylinders function as magnetic brushes that transport magnetic developer (e.g. magnetic carrier particles with electrostatically attracted toner particles) into contact with the electrostatic images on a photoconductor. In another use such magnetic cylinders elements are used in scavenger rollers to remove any carrier particles that were erroneously deposited on the photoconductor along with the desired toner transfer.

In both the developer roller and scavenger roller systems, device constructions vary greatly. Magnetic brush devices can be constructed with a rotating magnetic cylindrical core within a stationary non-magnetic cylindrical shell or with a stationary magnetic core within a rotating non-magnetic shell, or both the magnetic core and the outer shell can be constructed to rotate, see e.g. U.S. Pat. No. 4,473,029. Scavenger roller devices also vary considerably in design approach.

Beyond the general design approach, the magnetic brush and scavenger devices will have design details that depend significantly on the characteristics of the overall electrostatographic system, e.g. its particular developer composition, the photoconductor speed, the strength of the electrostatic image pattern, etc. One of the very important design details of such devices is the magnetization pattern of their permanent magnet cylinder element(s), so that each different electrostatographic apparatus design benefits from a "custom designed" magnetization pattern for its developing and scavenging devices.

In one prior art approach, elongated strip magnets are attached at predetermined positions around the periphery of a cylindrical iron core to construct desired magnetization patterns. In another, a plurality of magnet elements are adhered together to form a cylinder with the desired magnetization pattern. In a more recent design approach, a cylinder formed of permanent magnet material such as molded ferrite is placed in a custom magnetizing fixture and impressed with the desired polarization pattern.

The last-noted approach is desirable from the viewpoint of material and assembly costs, once the appropriate fixture has been developed. However, the design and fabrication of the fixture is not an insignificant endeavor. For example, such prior art fixtures can comprise a block of phenolic or other suitable dielectric material, centrally bored to allow the magnet element to be magnetized to fit with a small clearance. A heavy gauge wire conductor is threaded through groups of holes drilled longitudinally through the block, adjacent to the central bore, in predetermined locations based upon the desired magnetization pattern to be achieved. The element to be magnetized is inserted in the bore and the wire ends are coupled to a capacitor discharge magnetizer.

The entire assembly is then inserted into a water cooled shell and a high current pulse is directed through the wires to produce magnetic fields that magnetize the inserted element in the proper polarization pattern.

The magnetizing fixture described above is expensive to construct. Moreover, the interactions of the various instrumentalities make calculating the predesign of a fixture that will provide a precise polarization pattern, virtually impossible. Thus repeated fixtures designs are calculated and constructed in attempts to develop approximately the desired field by trial and error. At some stage a compromise is attained between the preciseness of the polarization patterns formed by a given fixture design and the cost of continuing to refine the design by constructing new fixtures. Whenever the overall machine design changes to necessitate a different preferred polarization pattern, it is necessary to repeat the process of fixture design as described above.

Considering the foregoing, one can appreciate that it would be highly desirable to improve the apparatus, systems and processes for impressing precise polarization patterns upon cylindrical permanent magnet elements.

SUMMARY OF THE INVENTION

Thus, one important purpose of the present invention is to provide improved fixture devices and magnetization systems for enabling the fabrication of precisely magnetized, cylindrical permanent magnet elements. One important advantage of the present invention is that it allows less costly and faster development of magnetization systems. In accord with another important advantage, the present invention enables the fabrication of cylindrical permanent magnet elements having more precise polarization patterns. In addition, the magnetization fixtures of the present invention are susceptible to a high production rate, as elements are easily inserted and removed. Moreover, the fixtures according to the invention are highly reusable for producing elements based on different machine requirements.

Thus, in one aspect the present invention constitutes a fixture device for magnetizing cylindrical permanent magnet elements to have predetermined polarization patterns and includes: (i) a frame for supporting such element and at least partially encircling a region that is to be magnetized, (ii) a plurality of tip members formed of soft magnetic material and shaped to direct and focus magnetic fields, (iii) means for adjustably attaching the tip members to the frame in positions for directing and focusing fields into a supported element and (iv) means for directing a high current pulse around each of the tip members to cream polarizing fields directed into a supported element.

In another aspect the present invention constitutes a system for magnetizing permanent magnet elements including: (i) means for supporting such elements, (ii) a plurality of magnetizing assemblies including a soft magnetic tip portion, an associated wire winding portion and a dielectric matrix portion coupling the tip and winding portions, (iii) means for movably mounting each magnetizing assembly in a plurality of selectable polarization positions vis a vis a supported element and (iv) means for discharging a high current pulse through at least one of said assemblies to create magnetic fields that impress polarization patterns on the supported element in accord with the selected position of said magnetizing assemblies.

BRIEF DESCRIPTION OF DRAWINGS

The subsequent description of preferred embodiments of the invention refers to the accompanying drawings wherein.

DETAILED DESCRIPTION OF THE INVENTION

Figure 1:
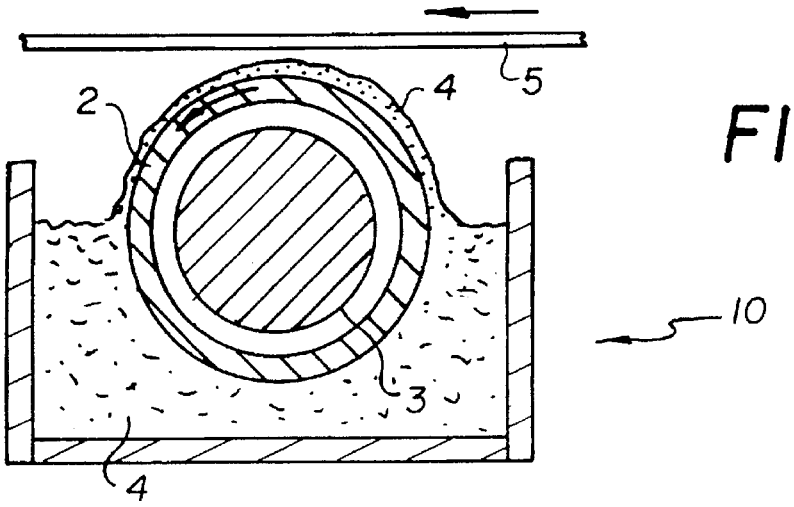
FIG. 1 is a schematic cross-sectional view of one magnetic brush toner applicator having a core magnetized in accord with the invention.
Figure 7:
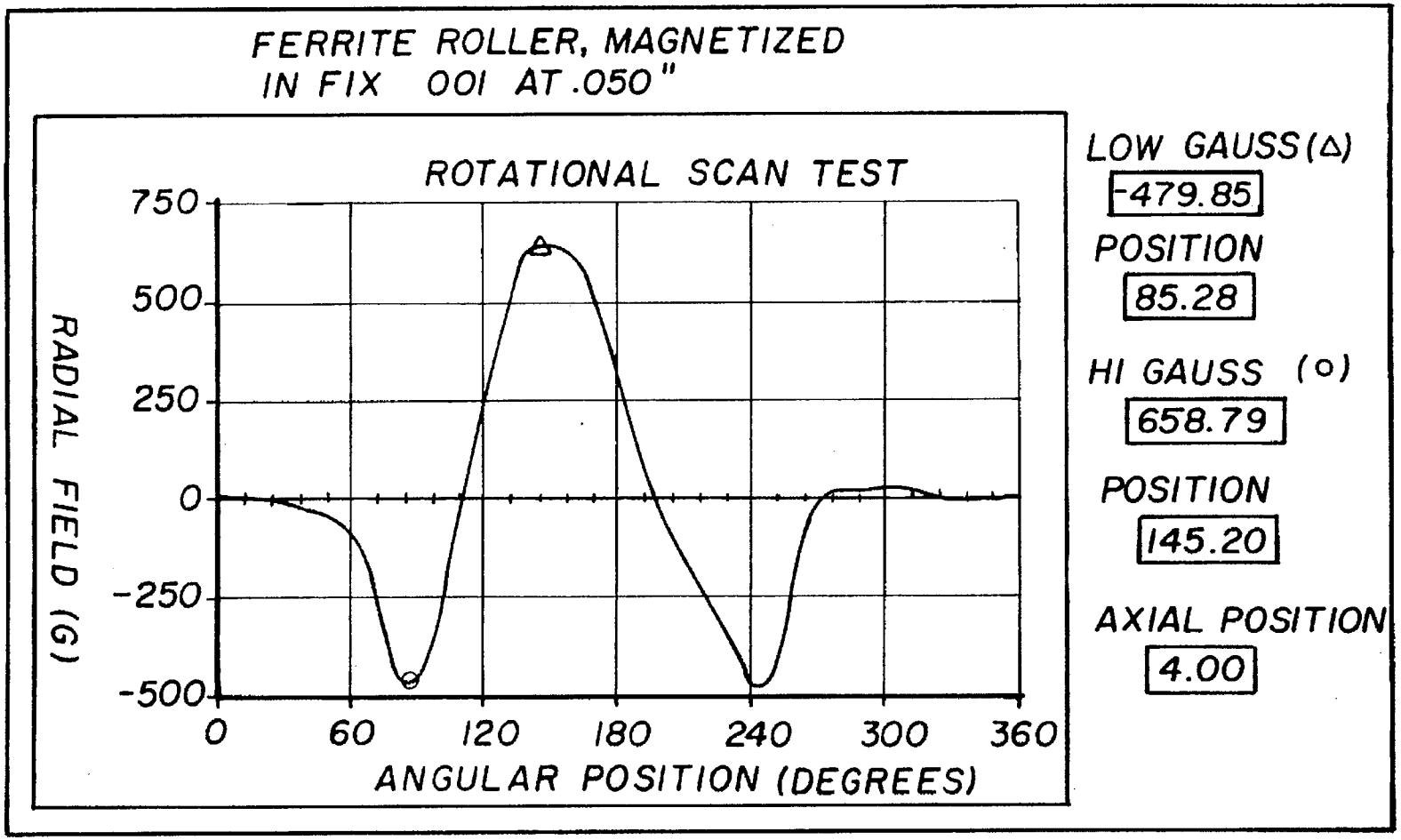
FIG. 7 is a diagram showing a computer screen of a magnetic roller test system with the plot of one field polarization pattern formed in accord with the present invention.

Referring briefly to FIG. 1, a cylindrical magnetic core 3 having a magnetic field characterized by predetermined polarization patters, e.g. such as shown in FIG. 7, is illustrated as embodied in electrostatographic developer assembly 10. In the FIG. 1 magnetic brush developer assembly 10, the magnetic core 3 is stationary and a non-magnetic steel shell 2 rotates around the core 3 to transport developer 4 (comprising toner and carrier) into contact with an electrostatic image bearing photoconductor 5.

Figure 2:
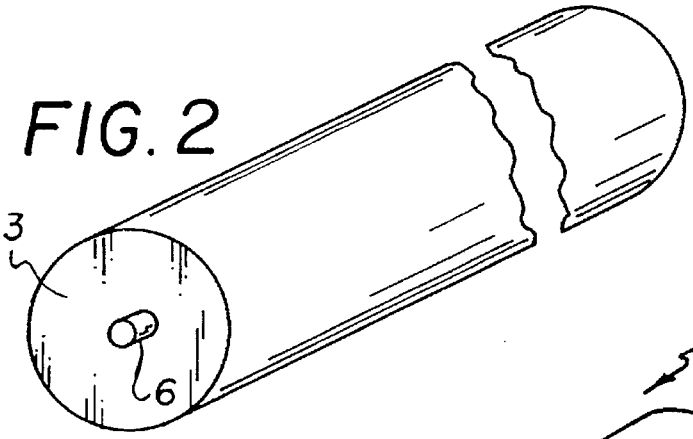
FIG. 2 is a perspective view of the permanent magnet core of the FIG. 1 assembly.

The cylindrical core 3 is shown in more detail in FIG. 2 to have a length, which corresponds substantially to the width of photoconductor 5. Core 2 can be formed of various permanent magnet materials but molded ferrite constructions are particularly desirable for practice of magnetization in accord with the invention. Suitable magnetic materials are composed of fine particles of barrium ferrite, neodynrium-iron-boron, samarium cobalt etc., in a polymer binder such as Nylon. Using materials such as this, magnets are fabricated typically by extrusion or injection molding. This material is generally unoriented, but may also be oriented during molding or extrusion.

Figure 3:
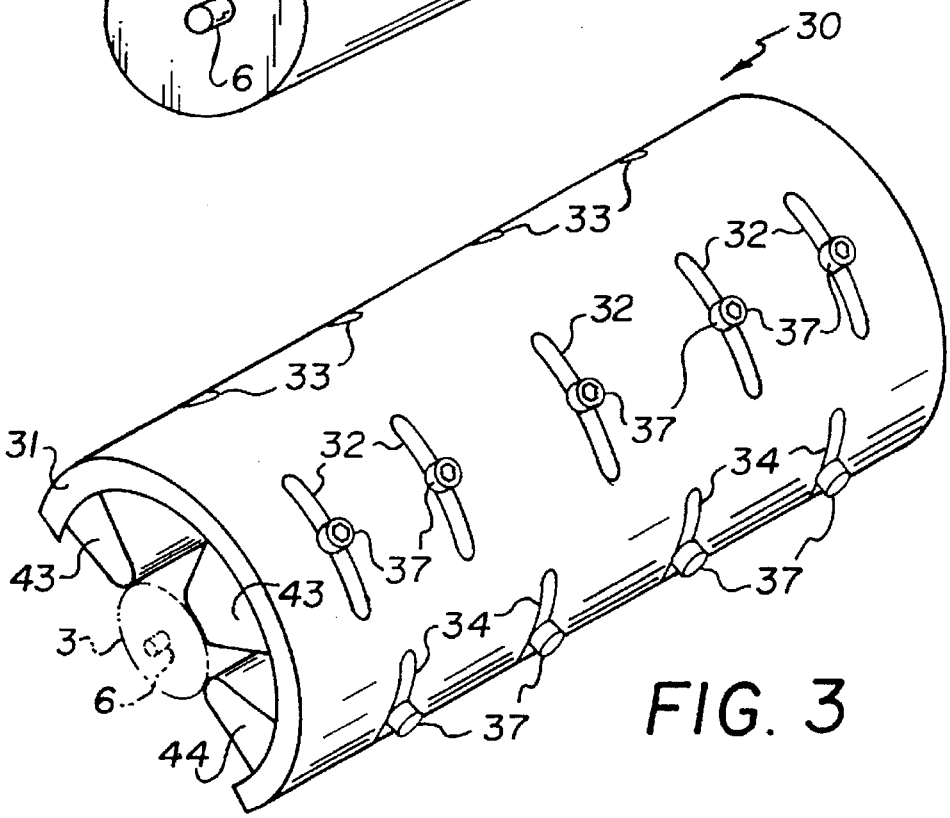
FIG. 3 is a perspective view of one fixture device in accord with the present invention with the FIG. 2 core's magnetizing location indicated with dotted lines.

FIG. 3 shows one preferred embodiment of magnetization fixture 30 constructed according to present invention. Thus, a frame means for supporting and at least partially encircling an inserted cored 3 (dotted lines), can comprise a cylinder shaped shell 31 section constructed of soft magnetic material, e.g. iron. The core 3 can be held in contact with fixture 30, e.g. by holding means (not shown) engaging its shaft 6, or by gravity. The frame has a plurality of groups of elongated mounting slots 32, 33 and 34 spaced along its length dimension at a plurality of different circumferential locations. As shown, the slots extend through the frame with their lengths running in the azmuthal direction, along the circumference.

Figure 4:
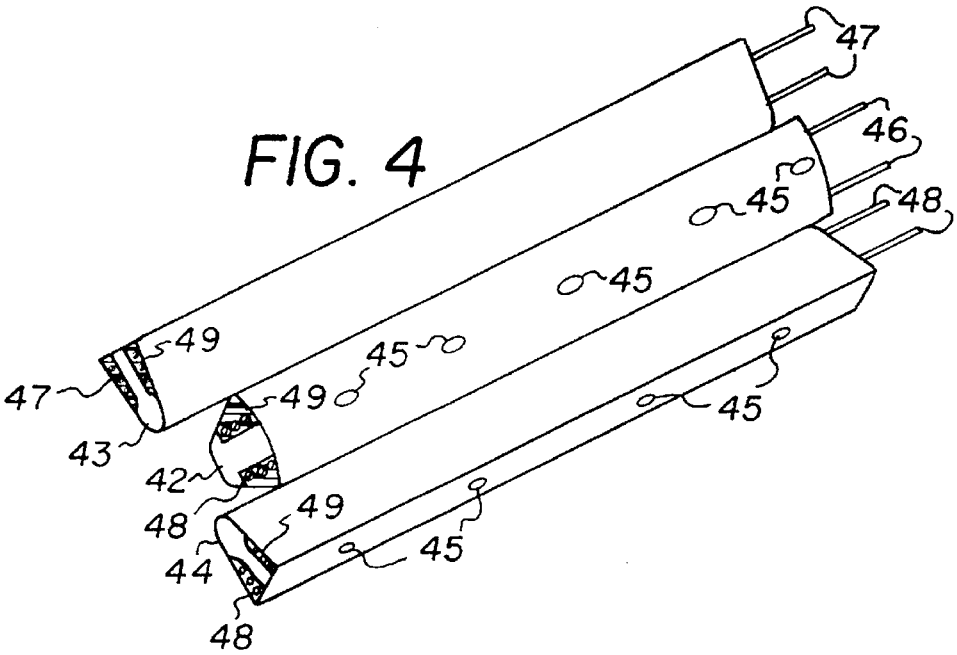
FIG. 4 is a perspective view showing one preferred embodiment of field focusing tip members in accord with the present invention.

FIG. 3 also shows a plurality of fixture tip members 42, 43 and 44, which can be seen in more detail in FIG. 4. The lip members are formed of soft magnetic material and comprise top end portions having attachment means, e.g. threaded bores 45, and opposite bottom ends shaped to direct and focus magnetic fields, as described below. In the FIG. 4 embodiment each of the lip members has an intermediate body portion shaped to receive wire coils winding 46, 47, 48, the coils of which loop around their respective tip member's longitudinal sides and have a terminal end for coupling to a power source. Also as shown in the FIG. 4 embodiment, a matrix of electrically non-conductive, non-magnetic material 49, e.g. a dielectric such as phenolic, retains the coil elements in spaced, electrically isolated positions visa vis the soft magnetic lip members 42, 43, 44. In preferred embodiments the matrices of material 49 are attached to their respective tip members for movement therewith.

Thus, fixture device 30 includes means for adjustably attaching each of lip members 42, 43, 44 to the frame shell 31. More specifically, in the FIG. 4 embodiment, such attachment means comprise bolt elements 37 that extend through the slots 32–34 of shell 31 and screw into bores 45 of the lip members 42–44. The bolt elements, when loosened, can slide along those shell slots so that the tip member assemblies can be independently located at a plurality of magnetizing positions visa vis an inserted core 3.

Figure 5:
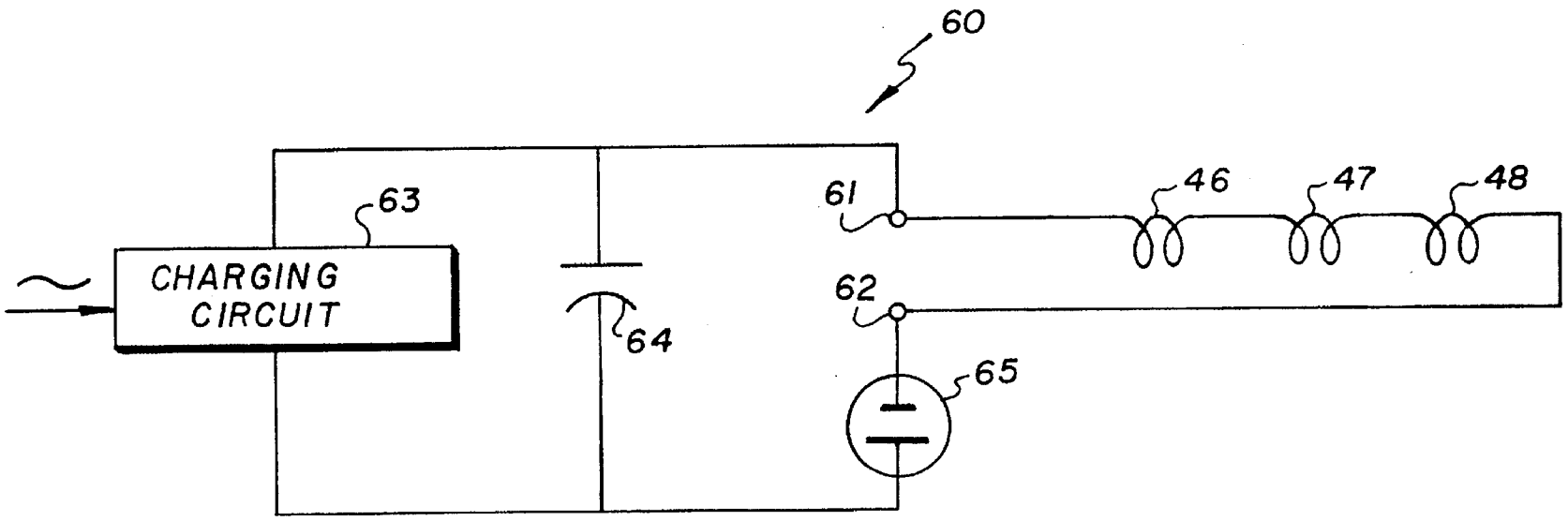
FIGS. 5 and 6 are schematic circuit diagrams illustrating the fixture device of FIGS. 3 and 4 coupled to a capacitor discharge magnetizer apparatus.
Figure 6:
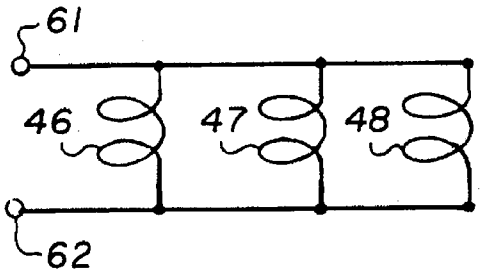

Referring now to FIG. 5, the fixture device 30 with an inserted core 3 and suitably positioned tip members can be coupled to terminals 61, 62 of a capacitor discharge magnetizing apparatus 60. In general such apparatus can comprise a charging circuit 63, capacitor storage means 64 and an Ignitron device 65 coupled as illustrated schematically in FIG. 5. One preferred magnetizing apparatus is a model 8500 sold by Magnetic Instrumentation, Inc. The size of the capacitor bank is tailored to the particular fixture so that the voltage build up is adequate to provide a current pulse to saturate the magnets but not so large to cause damage. In the FIG. 5 diagram, the coils 46, 47 and 48 are coupled in series to terminals 61, 62; however, in certain applications it may be desirable to couple the coils in parallel as illustrated in FIG. 6.

When the magnetizing apparatus 60 is actuated, current pulses pass through the coils 46, 47, 48 causing a magnetic flux to pass through the core 3 in predetermined paths and to saturate the core to a desired polarization pattern. One skilled in the art will appreciate that the fixture system of the present invention allows the number, size, shape and location of the tip members to be varied selectively, as each tip is constructed and positioned in the fixture independently of the others.

FIG. 7 shows an exemplary polarization pattern which can be formed in a cylindrical core 3, by a fixture set up like that shown in FIG. 3. The plot of FIG. 7 is generated by rotating a core 3, magnetized as described above, past a Hall effect sensor probe and plotting the radial field strength versus angular position of the core 3. It can be seen that the polarization pattern has a north pole peaking at about 150° and south poles peaking at about 90° and 240° of rotation. Plots such as shown in FIG. 7 can be utilized in accord with the present invention to direct tip member adjustments for modifying and fine tuning particular polarization patterns for particular uses.

Figure 8:
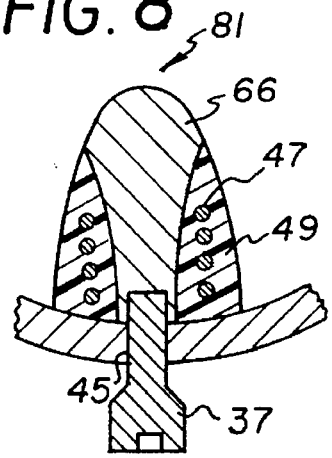
FIGS. 8–10 are cross section views showing alternative tip member configurations.
Figure 9:
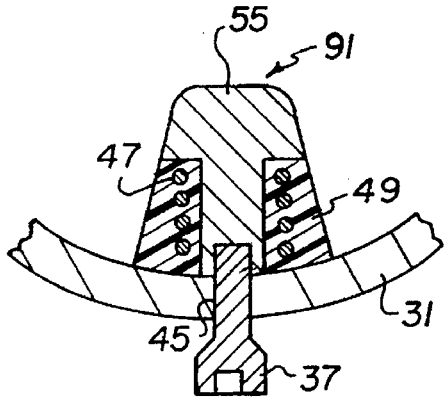
Figure 10:
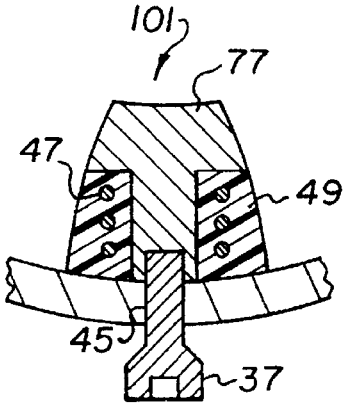
Figure 11:
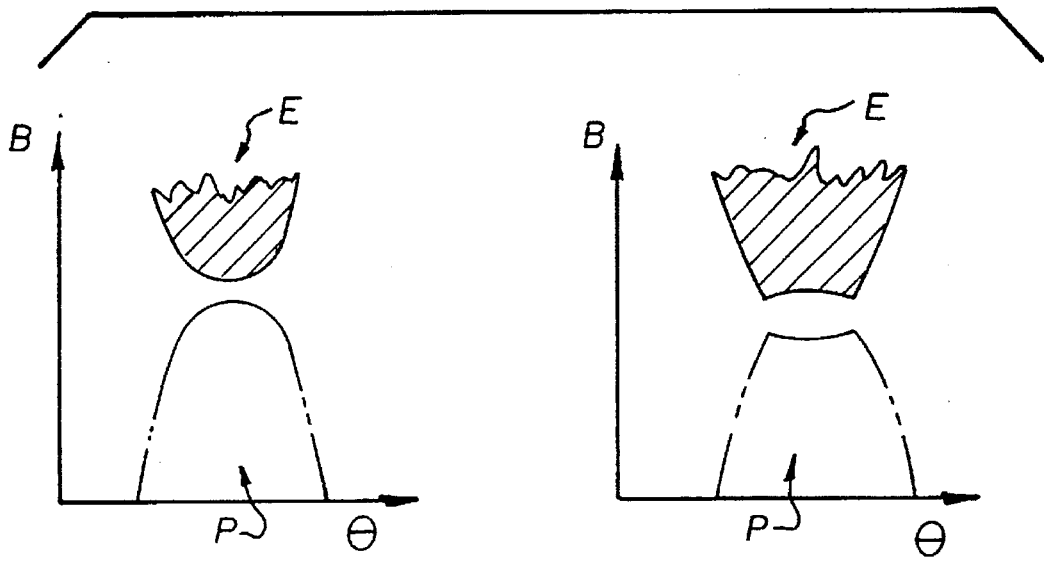
FIG. 11 is a diagram showing field shapes formed by tip member constructions in accord with the present invention.

In accord with another highly desirable feature of the present invention, we have found that desired changes in the shape of magnetization patterns can be achieved by modifying the configuration of the flux focusing tip portions of the adjustable tip members. For example, FIG. 8 illustrates a tip member embodiment having a fairly sharply rounded convex end portion 81, FIG. 9 illustrates such a member with a flat tip end portion 91 and FIG. 10 shows such member with a slightly concave tip end portion 101. FIG. 11 illustrates schematically how the polarization patterns P formed by the flux from such tip ends E correspond in configuration to the tip ends E which formed them. Thus, by shaping the ends of the adjustable positionable and sized tip members, another tool is provided for attainment of the precisely desired polarization pattern.

Figure 12:
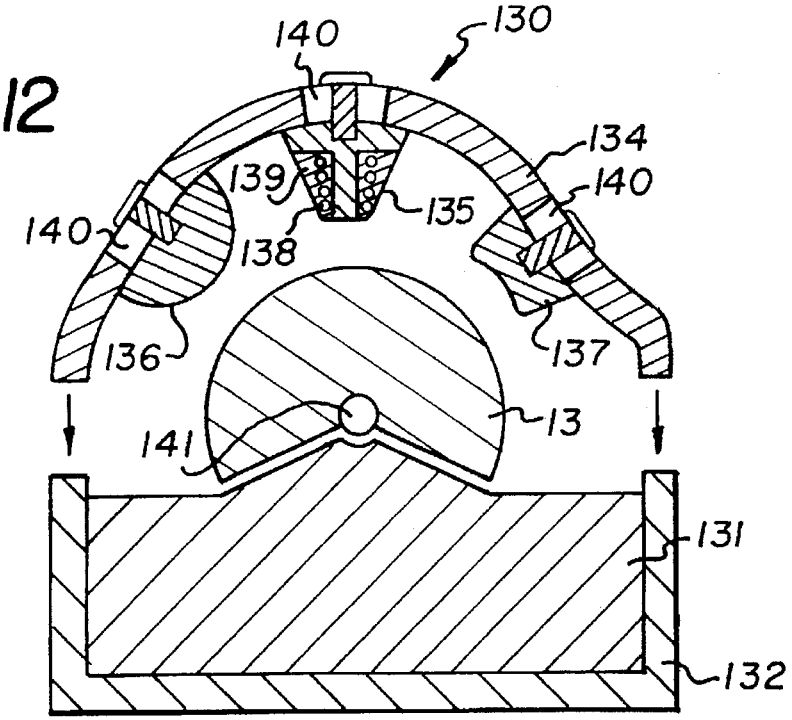
FIG. 12 is a cross-sectional view showing another fixture embodiment in accord with the present invention.

FIG. 12 illustrates another preferred fixture device 130 in accord with the present invention. In this embodiment a cylindrical sector core 13 supported on shaft 141 is placed onto a dielectric matrix portion 131 of a base member 132. A frame member 134 is shaped to fit onto base 132 with supported tip members 135, 136, 137 proximate the supported cylinder portion 13. In this embodiment the tip members are again adjustable, in slots 140; however, only tip member 135 has a flux generating coil 138 in matrix 139. This embodiment illustrates that when weaker pole features are desired, the flux which passes from tip 135 through element 13 and out into members 136 and 137 can be sufficient to effect the magnetization patterns. FIG. 12 also illustrates the use of differing tip end configurations and it will be appreciated that various combinations of the above teachings will be useful to those skilled in the art to attain particular polarization patterns for cylinders and other similar permanent magnet elements.

The invention has been described in detail with particular reference to preferred embodiments thereof, but it will be understood that variations and modifications can be effected within the spirit and scope of the invention.

What is claimed is:

1. A fixture device for magnetizing permanent magnet cylindrical elements with predetermined patterns of polarization, said fixture device comprising:

a) means for supporting a permanent magnet element in a predetermined position and for at least partially encircling a region of such element that is to be magnetized;

b) a plurality of tip members formed of soft magnetic material and shaped to direct and focus magnetic fields;

c) means for adjustably attaching said tip members to said supporting means in positions for directing and focusing fields into a supported permanent magnet element; and d) means for directing a high current pulse around at least one of said attached tip members.

2. The fixture device defined in claim 1 wherein said high current pulse directing means comprising a plurality of wire coil windings in a dielectric matrix extending around said plurality of tip members respectively.

3. The fixture device defined in claim 2 wherein each of said wire coil windings has an associated dielectric matrix that is attached to a respective tip member for adjustment therewith.

4. The fixture device defined in claim 3 wherein each of said tip members is mounted for sliding movement in relation to said supporting means so as to be selectively positionable to focus fields into different locations of a supported permanent magnet element.

5. The fixture device defined in claim 4 wherein said support means includes a cylindrical shell formed of soft magnetic material.

6. The fixture device defined in claim 5 wherein said cylindrical shell has a plurality of circumferential slots and said adjustable attaching means are constructed to slide in said slots to adjustably position said tip members and their associated wire coil windings and dielectric matricies.

7. The fixture device defined in claim 1 wherein at least some of said plurality of tip members have rounded end portions.

8. The fixture device defined in claim 1 wherein at least some of said plurality of tip members have flat edge end portions.

9. The fixture device defined in claim 1 wherein said plurality of tip members are independently adjustable to different positions on said supporting means.

10. A system for magnetizing permanent magnet cylinder or cylinder sector elements, said system comprising a) means for supporting permanent magnet cylinder or cylinder sector elements at a predetermined location;

b) a plurality of magnetizing members each including a soft magnetic field focusing tip, an associated wire winding and a dielectric matrix coupling such magnetic field focusing tip and wire winding;

c) means for movably mounting each of said magnetizing members in a plurality of selectable polarization positions in relation to a supported permanent magnet cylinder or cylinder sector element; and d) means for discharging a high current pulse through said wire windings to impress magnetic polarization patterns upon such supported permanent magnet cylinder or cylinder sector element in accord with the position of said magnetizing members.

11. The magnetizing system defined in claim 10 wherein said discharging means is adjustable to vary the magnitude of current pulses.

* * * * *